US008568291B2

(12) United States Patent
Ball et al.

(10) Patent No.: US 8,568,291 B2
(45) Date of Patent: Oct. 29, 2013

(54) BONE CONDUCTIVE DEVICES FOR IMPROVING HEARING

(75) Inventors: Geoffrey R. Ball, Axams (AT); Peter Lampacher, Innsbruck (AT)

(73) Assignee: Vibrant Med-El Hearing Technology GmbH, Innsbruck (AT)

( * ) Notice: Subject to any disclaimer, the term of this patent is extended or adjusted under 35 U.S.C. 154(b) by 0 days.

(21) Appl. No.: 13/532,860

(22) Filed: Jun. 26, 2012

(65) Prior Publication Data

US 2012/0271097 A1 Oct. 25, 2012

Related U.S. Application Data

(62) Division of application No. 11/354,617, filed on Feb. 14, 2006, now Pat. No. 8,246,532.

(51) Int. Cl.
*H04R 25/00* (2006.01)

(52) U.S. Cl.
USPC ..... 600/25; 381/312; 381/326

(58) Field of Classification Search
USPC ..... 600/25; 128/897–898; 381/312–321
See application file for complete search history.

(56) References Cited

U.S. PATENT DOCUMENTS

2004/0032962 A1* 2/2004 Westerkull ..... 381/151

OTHER PUBLICATIONS

Robert A Battista, Steven Ho. "The bone-anchored hearing device (BAHA)." Operative Techniques in Otolaryngology—Head and Neck Surgery. 14.4 (Dec. 2003): 272-276. Web Mar. 11, 2013.*
"Coin Specifications." United States Mint. Web. Mar. 12, 2013. http://www.usmint.gov/about_the_mint/?action=coin_specifications.*

* cited by examiner

*Primary Examiner* — Charles A Marmor, II
*Assistant Examiner* — Carrie R Dorna
(74) *Attorney, Agent, or Firm* — Sunstein Kann Murphy & Timbers LLP

(57) ABSTRACT

A method is described for providing sound perception in a hearing impaired patient. An externally generated electrical audio stimulation signal is received in a receiver unit located under the skin of an implanted patient. The electrical audio stimulation signal is delivered to an implanted bone conduction transducer having a planar bone engagement surface mounted to a temporal bone surface of the patient. The electrical audio stimulation signal is transformed into a corresponding mechanical stimulation signal coupled to the temporal bone by the bone engagement surface for delivery by bone conduction through the temporal bone to the cochlear fluid of the patient for perception as sound.

7 Claims, 6 Drawing Sheets

(A)

(B)

(A)

(B)

BONE CONDUCTIVE DEVICES FOR IMPROVING HEARING

This application is a divisional of U.S. patent application Ser. No. 11/354,617, filed Feb. 14, 2006, which is incorporated herein by reference.

TECHNICAL FIELD

The present invention relates to partially implantable medical devices for improving sound perception by subjects with conductive or mixed conductive/sensorineural hearing loss. In particular, the present invention provides methods and devices for vibrating the skull of a hearing impaired subject.

BACKGROUND ART

Hearing impairment can be characterized according to its physiological source. There are two general categories of hearing impairment, conductive and sensorineural. Conductive hearing impairment results from diseases or disorders that limit the translation of acoustic sound as vibrational energy through the external and/or middle ear structures. Approximately 1% of the human population is estimated to have ears that have a less than ideal conductive path for acoustic sound. In contrast, sensorineural hearing impairment occurs in the inner ear and/or neural pathways. In patients with sensorineural hearing impairment, the external and middle ear function normally (e.g., sound vibrations are transmitted undisturbed through the eardrum and ossicles where fluid waves are created in the cochlea). However, due to damage to the pathway for sound impulses from the hair cells of the inner ear to the auditory nerve and the brain, the inner ear cannot detect the full intensity and quality of the sound. Sometimes conductive hearing loss occurs in combination with sensorineural hearing loss. In other words, there may be damage in the outer or middle ear, and in the inner ear or auditory nerve. When this occurs, the hearing loss is referred to as a mixed hearing loss. Many conditions can disrupt the delicate hearing structures of the middle ear. Common causes of conductive hearing loss include congenital defect, infection (e.g., otitis media), disease (e.g., otosclerosis), blockage of the outer ear, and trauma (e.g., perforated ear drum).

There are several treatment options for patients with middle hear hearing loss. With conventional acoustic hearing aids, sound is detected by a microphone and converted into an electrical signal, which is amplified using amplification circuitry, and transmitted in the form of acoustical energy by a speaker or other type of transducer. Often the acoustical energy delivered by the speaker is detected by the microphone, causing a high-pitched feedback whistle. Moreover, the amplified sound produced by conventional hearing aids normally includes a significant amount of distortion. Some early hearing aids were also equipped with external bone vibrators that would shake the skin and skull in response to sound. The bone vibrators had to be worn in close contact with the skull in order to transduce signal to the inner ear, thereby causing chronic skin irritation in many users. In addition, external bone vibrators were notably inefficient. These drawbacks spurred the development of microsurgical techniques for the treatment of conductive hearing loss. In fact, otologic surgery (e.g., tympanoplasty, ossiculloplasty, implantation of total or partial ossicular replacement prothesis, etc.) has become an accepted treatment for the repair and/or reconstruction of the vibratory structures of the middle ear. However, these types of procedures are complex and are associated with the usual risks related to major surgery. In addition, techniques requiring disarticulation (disconnection) of one or more of the bones of the middle ear deprive the patient of any residual hearing he or she may have had prior to surgery. This places the patient in a worsened position if the implanted device is later found to be ineffective in improving the patient's hearing.

Thus, there remains a need in the art for medical devices and techniques, which provide improved sound perception by individuals with conductive or mixed hearing loss. In particular, there is a need in the art for hearing aids that efficiently transduce acoustic energy to the inner ear without risk of destroying a patient's residual hearing. The present invention provides hearing devices that provide suitable stimulation to structures of the inner ear resulting in superior hearing correction, and which can be partially implanted in a simple outpatient procedure.

SUMMARY

Embodiments of the present invention are directed to a method for providing sound perception in a hearing impaired patient. An externally generated electrical audio stimulation signal is received in a receiver unit located under the skin of an implanted patient. The electrical audio stimulation signal is delivered to an implanted bone conduction transducer having a planar bone engagement surface mounted to a temporal bone surface of the patient. The electrical audio stimulation signal is transformed into a corresponding mechanical stimulation signal coupled to the temporal bone by the bone engagement surface for delivery by bone conduction through the temporal bone to the cochlear fluid of the patient for perception as sound.

In further specific embodiments, the transducer may include a transducer housing containing a first mass that vibrates relative to a second mass when developing the mechanical stimulation signal. For example, the first mass may include a permanent magnet, and the second mass may include an electromagnetic coil coupled to the transducer housing, and the electrical audio stimulation signal is applied to the coil and causes the magnet to vibrate relative to the transducer housing.

In some embodiments, the electrical audio stimulation signal may be delivered to the transducer by one or more leads of less than 15 mm in length. The transducer may have a diameter of less than 30 mm and a width of less than 7 mm. The hearing impaired patient may have one or more of the following conditions, malformation of the external ear canal or middle ear, chronic otitis media, tumor of the external ear canal or tympanic cavity. In addition or alternatively, the hearing impaired patient may have a maximum measurable bone conduction level of less than 50 dB at 50, 1000, 2000 and 3000 Hertz.

DETAILED DESCRIPTION

Figure 1:
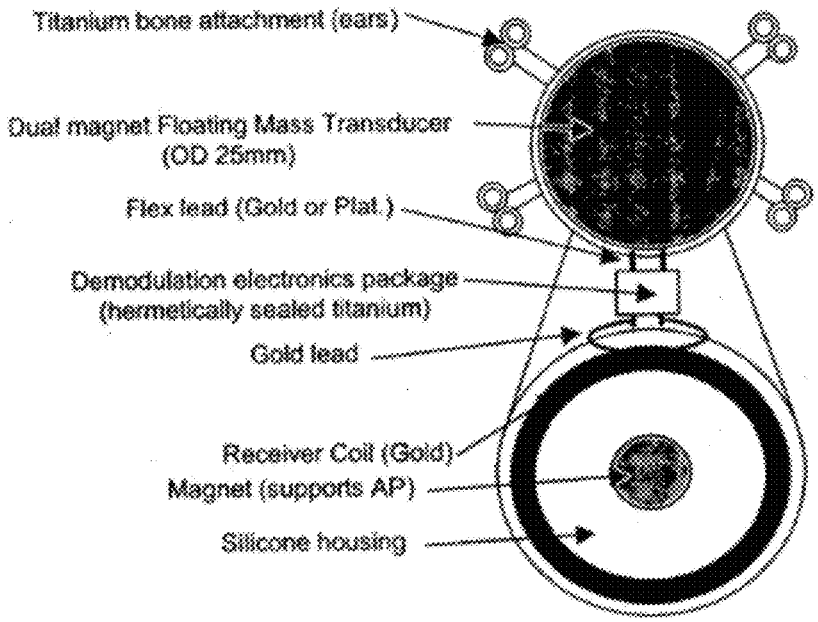
FIG. 1A-B shows a top plan view and side cross-sectional view respectively of an embodiment of the present invention (known as "BoneBridge Flex") having a demodulator positioned between a vibratory unit comprising a floating mass transducer (FMT) and a receiver unit comprising a receiver coil.
Figure 1:
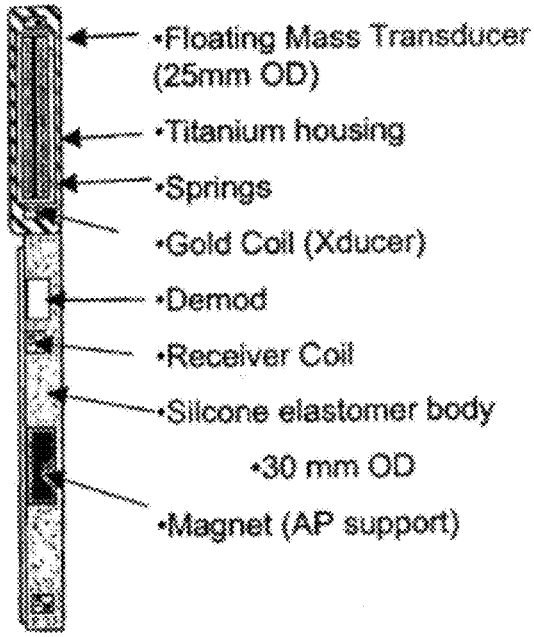

To facilitate an understanding of the present invention, a number of terms and phrases are defined below.

As used herein, the term "subject" refers to a human or other animal. It is intended that the term encompass patients, such as hearing impaired patients. Subjects that stutter are also expected to receive benefit from the hearing devices disclosed herein.

The terms "hearing impaired subject" and "hearing impaired patient" refer to animals or persons with any degree of loss of hearing that has an impact on the activities of daily living or that requires special assistance or intervention. In preferred embodiments, the term hearing-impaired subject refers to a subject with conductive or mixed hearing loss.

As used herein, the terms "external ear canal" and "external auditory meatus" refer to the opening in the skull through which sound reaches the middle ear. The external ear canal extends to the tympanic membrane (or "eardrum"), although the tympanic membrane itself is considered part of the middle ear. The external ear canal is lined with skin, and due to its resonant characteristics, provides some amplification of sound traveling through the canal. The "outer ear" includes those parts of the ear that are normally visible (e.g., the auricle or pinna, and the surface portions of the external ear canal).

As used herein, the term "middle ear" refers to the portion of the auditory system that is internal to the tympanic membrane, and including the tympanic membrane, itself. It includes the auditory ossicles (i.e., malleus, incus, and stapes, commonly known as the hammer, anvil, and stirrup) that from a bony chain (e.g., ossicular chain) across the middle ear chamber to conduct and amplify sound waves from the tympanic membrane to the oval window. The ossicles are secured to the walls of the chamber by ligaments. The middle ear is open to the outside environment by means of the eustachian tube.

As used herein, the term "inner ear" refers to the fluid-filled portion of the ear. Sound waves relayed by the ossicles to the oval window are created in the fluid, pass through the cochlea to stimulate the delicate hair-like endings of the receptor cells of the auditory nerve. These receptors generate electrochemical signals that are interpreted by the brain as sound.

The term "cochlea" refers to the part of the inner ear that is concerned with hearing. The cochlea is a division of the bony labyrinth located anterior to the vestibule, coiled into the form of a snail shell, and having a spiral canal in the petrous part of the temporal bone.

As used herein, the term "cochlear hair cell" refers to the sound sensing cell of the inner ear, which have modified ciliary structures (e.g., hairs), that enable them to produce an electrical (neural) response to mechanical motion caused by the effect of sound waves on the cochlea. Frequency is detected by the position of the cell in the cochlea and amplitude by the magnitude of the disturbance.

The term "cochlear fluid" refers to the liquid within the cochlea that transmits vibrations to the hair cells.

The terms "round window" and "fenestra of the cochlea" refer to an opening in the medial wall of the middle ear leading into the cochlea.

The term "temporal bone" refers to a large irregular bone situated in the base and side of the skull, including the, squamous, tympanic and petrous. The term "mastoid process" refers to the projection of the temporal bone behind the ear.

As used herein, the term "Bone Bridge" refers to medical prostheses that serve to improve the sound perception (hearing) by individuals. Although it is not intended that the present invention be so limited, in particularly preferred embodiments, Bone Bridge devices are used to improve the hearing of individuals with conductive (i.e., the ossicular connection is broken, loose, stuck, or missing) or mixed sensorineural and conductive hearing loss. Unlike hearing aids that take a sound and make it louder as it enters the middle ear, in particularly preferred embodiments, Bone Bridge devices convert acoustic sound to vibrations transmitted to the skull of a subject. These vibrations are amplified by device electronics in order to make the vibrations stronger than the patient would normally achieve with sound transmitted through the ear canal and across the eardrum. Since in some embodiments, no portion of the Bone Bridge device is present in the ear canal, problems commonly experienced with hearing aids (e.g., occlusion, discomfort, irritation, soreness, feedback, external ear infections, etc.) are eliminated or reduced.

In highly preferred embodiments, the Bone Bridge device is divided into at least two components, with the external portion comprising an audio processor (e.g., comprised of a microphone, battery, and the electronics needed to convert sound to a signal that can be transmitted) and the internal portion comprising an internal receiver and vibrator. In some embodiments, the receiver and vibrator are part of an integrated device, while in other embodiments, the receiver and vibrator comprise distinct couplable devices. The audio processor is positioned on the wearer's head with a magnet. A signal from the audio processor is transmitted across the skin to the internal receiver, which then relays the signal to a transducer (e.g., FMT) of the vibrator. In turn, the FMT converts the signal to vibrations transmitted to the skull of a subject and ultimately to the cochlear fluid of the inner ear. Thus, in preferred embodiments, ambient sounds (e.g., voices, etc.) are picked up by the microphone in the audio processor and converted to an electrical signal within the audio processor. This electrical signal is then transmitted across the skin to the internal receiver, which then conveys the signal to the FMT via a conducting link, resulting in mechanical vibration of the skull, which is perceived as sound by the subject wearing the device.

As used herein, the terms "power source" and "power supply" refer to any source (e.g., battery) of electrical power in a form that is suitable for operating electronic circuits. Alternating current power may be derived either directly or by means of a suitable transformer. "Alternating current" refers to an electric current whose direction in the circuit is periodically reversed with a frequency f that is independent of the circuit constants. Direct current power may be supplied from various sources, including, but not limited to batteries, suitable rectifier/filter circuits, or from a converter. "Direct current" refers to a unidirectional current of substantially constant value. The term also encompasses embodiments that include a "bus" to supply power to several circuits or to several different points in one circuit.

A "power pack" is used in reference to a device that converts power from an alternating current or direct current supply, into a form that is suitable for operating electronic device(s).

As used herein, the term "battery" refers to a cell that furnishes electric current to the hearing devices of the present invention. In some embodiments of the present invention, "rechargeable" batteries are used.

As used herein, the term "microphone" refers to a device that converts sound energy into electrical energy. It is the converse of the loudspeaker, although in some devices, the speaker-microphone may be used for both purposes (i.e., a loudspeaker microphone). Various types of microphones are encompassed by this definition, including carbon, capacitor, crystal, moving-coil, and ribbon embodiments. Most microphones operate by converting sound waves into mechanical vibrations that then produce electrical energy. The force exerted by the sound is usually proportional to the sound pressure. In some embodiments, a thin diaphragm is mechanically coupled to a suitable device (e.g., a coil). In alternative embodiments, the sound pressure is converted to electrical pressure by direct deformation of suitable magnetorestrictive or piezoelectric crystals (e.g., magnetorestriction and crystal microphones).

As used herein, the term "amplifier" refers to a device that produces an electrical output that is a function of the corresponding electrical input parameter, and increases the magnitude of the input by means of energy drawn from an external source (i.e., it introduces gain). "Amplification" refers to the reproduction of an electrical signal by an electronic device, usually at an increased intensity. "Amplification means" refers to the use of an amplifier to amplify a signal. It is intended that the amplification means also include means to process and/or filter the signal.

As used herein, the term "transmitter" refers to a device, circuit, or apparatus of a system that is used to transmit an electrical signal to the receiving part of the system. A "transmitter coil" is a device that receives an electrical signal and broadcasts it to a "receiver coil." It is intended that transmitter and receiver coils may be used in conjunction with centering magnets, which function to maintain the placement of the coils in a particular position and/or location.

As used herein, the term "receiver" refers to the part of a system that converts transmitted waves into a desired form of output. The range of frequencies over which a receiver operates with a selected performance (i.e., a known level of sensitivity) is the "bandwidth" of the receiver. The "minimal discernible signal" is the smallest value of input power that results in output by the receiver.

As used herein, the term "transducer" refers to any device that converts a non-electrical parameter (e.g., sound, pressure or light), into electrical signals or vice versa. Microphones are one type of electroacoustic transducer. As used herein, the terms "floating mass transducer" and "FMT," refer to a transducer with a mass that vibrates in direct response to an external signal corresponding to sound waves. The mass is mechanically coupled to a housing, which in preferred embodiments is mountable to the skull. Thus, the mechanical vibration of the floating mass is transformed into a vibration of the skull allowing the patient to perceive sound.

The term "coil" refers to an object made of wire wound in a spiral configuration, used in electronic applications.

The term "magnet" refers to a body (e.g., iron, steel or alloy) having the property of attracting iron and producing a magnetic field external to itself, and when freely suspended, of pointing to the poles.

As used herein, the term "magnetic field" refers to the area surrounding a magnet in which magnetic forces may be detected.

The term "leads" refers to wires covered with an insulator used for conducting current between device components (e.g., receiver to transducer).

The term "housing" refers to the structure encasing or enclosing the magnet and coil components of the transducer. In preferred embodiments, the "housing" is produced from a "biocompatible" material.

As used herein, the term "biocompatible" refers to any substance or compound that has minimal (i.e., no significant difference is seen compared to a control) to no irritant or immunological effect on the surrounding tissue. It is also intended that the term be applied in reference to the substances or compounds utilized in order to minimize or to avoid an immunologic reaction to the housing or other aspects of the invention. Particularly preferred biocompatible materials include, but are not limited to titanium, gold, platinum, sapphire, and ceramics.

As used herein, the term "implantable" refers to any device that may be surgically implanted in a patient. It is intended that the term encompass various types of implants. In preferred embodiments, the device may be implanted under the skin (i.e., subcutaneous), or placed at any other location suited for the use of the device (e.g., within a subject's temporal bone). An implanted device is one that has been implanted within a subject, while a device that is "external" to the subject is not implanted within the subject (i.e., the device is located externally to the subject's skin). Similarly, the term "surgically implanting" refers to the medical procedure whereby the hearing device is placed within a living body.

As used herein, the term "hermetically sealed" refers to a device or object that is sealed in a manner that liquids or gases located outside the device are prevented from entering the interior of the device, to at least some degree. "Completely hermetically sealed" refers to a device or object that is sealed in a manner such that no detectable liquid or gas located outside the device enters the interior of the device. It is intended that the sealing be accomplished by a variety of means, including but not limited to mechanical, glue or sealants, etc. In particularly preferred embodiments, the hermetically sealed device is made so that it is completely leak-proof (i.e., no liquid or gas is allowed to enter the interior of the device at all).

The term "vibrations" refer to limited reciprocating motions of a particle of an elastic body or medium in alternately opposite directions from its position of equilibrium, when that equilibrium has been disturbed.

As used herein, the term "acoustic wave" and "sound wave" refer to a wave that is transmitted through a solid, liquid, and/or gaseous material as a result of the mechanical vibrations of the particles forming the material. The normal mode of wave propagation is longitudinal (i.e., the direction of motion of the particles is parallel to the direction of wave propagation), the wave therefore consists of compressions and rarefactions of the material. It is intended that the present invention encompass waves with various frequencies, although waves falling within the audible range of the human ear (e.g., approximately 20 Hz to 20 kHz) are particularly preferred. Waves with frequencies greater than approximately 20 kHz are "ultrasonic" waves.

As used herein, the term "frequency" (v or]) refers to the number of complete cycles of a periodic quantity occurring in a unit of time. The unit of frequency is the "hertz," corresponding to the frequency of a periodic phenomenon that has a period of one second. Table 1 below lists various ranges of frequencies that form part of a larger continuous series of frequencies. Internationally agreed radiofrequency bands are shown in this table. Microwave frequencies ranging from VHF to EHF bands (i.e., 0.225 to 100 GHz) are usually subdivided into bands designated by the letters, P, L, S, X, K, Q, V, and W.

TABLE 1

Radiofrequency Bands

| Frequency | Band | Wavelength |
|---|---|---|
| 300 to 30 GHz | Extremely High Frequency (EHF) | 1 mm to 1 cm |
| 30 to 3 GHz | Superhigh Frequency (SHF) | 1 cm to 10 cm |
| 3 to 0.3 GHz | Ultrahigh Frequency (UHF) | 10 cm to 1 m |
| 300 to 30 MHz | Very High Frequency (VHF) | 1 m to 10 m |
| 30 to 3 MHz | High Frequency (HF) | 10 m to 100 m |
| 3 to 0.3 MHz | Medium Frequency (MF) | 100 m to 1000 m |
| 300 to 30 kHz | Low Frequency (LF) | 1 km to 10 km |
| 30 to 3 kHz | Very Low Frequency (VLF) | 10 km to 100 km |

As used herein, the term "gain," measured in decibels, is used as a measure of the ability of an electronic circuit, device, or apparatus to increase the magnitude of a given electrical input parameter. In a power amplifier, the gain is the ratio of the power output to the power input of the amplifier. "Gain control" (or "volume control") is a circuit or device that varies the amplitude of the output signal from an amplifier.

As used herein, the term "decibel" (dB) is a dimensionless unit used to express the ratio of two powers, voltages, currents, or sound intensities. It is 10× the common logarithm of the power ratio. If two power values (P1 and P2) differ by n decibels, then n=10 logio(P2/P1), or P2/P1=lonno. If P1 and P2 are the input and output powers, respectively, of an electric network, if n is positive (i.e., P2>P1), there is a gain in power. If n is negative (i.e., P1>P2), there is a power loss.

As used herein, the terms "carrier wave" and "carrier" refer to a wave that is intended to be modulated or, in a modulated wave, the carrier-frequency spectral component. The process of modulation produces spectral components termed "sidebands" that fall into frequency bands at either the upper ("upper sideband") or lower ("lower sideband") side of the carrier frequency. A sideband in which some of the spectral components are greatly attenuated is referred to a "vestigial sideband." Generally, these components correspond to the highest frequency in the modulating signals. A single frequency in a sideband is referred to as a "side frequency," while the "baseband" is the frequency band occupied by all of the transmitted modulating signals.

As used herein, the term "modulation" is used in general reference to the alteration or modification of any electronic parameter by another. For example, it encompasses the process by which certain characteristics of one wave (the "carrier wave" or "carrier signal") are modulated or modified in accordance with the characteristic of another wave (the "modulating wave"). The reverse process is "demodulation," in which an output wave is obtained that has the characteristics of the original modulating wave or signal. Characteristics of the carrier that may be modulated include the amplitude, and phase angle. Modulation by an undesirable signal is referred to as "cross modulation," while "multiple modulation" is a succession of processes of modulation in which the whole, or part of the modulated wave from one process becomes the modulating wave for the next.

As used herein, the term "demodulator" ("detector") refers to a circuit, apparatus, or circuit element that demodulates the received signal (i.e., extracts the signal from a carrier, with minimum distortion). "A modulator" is any device that effects modulation.

As used herein, the term "dielectric" refers to a solid, liquid, or gaseous material that can sustain an electric field and act as an insulator (i.e., a material that is used to prevent the loss of electric charge or current from a conductor, insulators have a very high resistance to electric current, so that the current flow through the material is usually negligible).

As used herein, the term "electronic device" refers to a device or object that utilizes the properties of electrons or ions moving in a vacuum, gas, or semiconductor. "Electronic circuitry" refers to the path of electron or ion movement, as well as the direction provided by the device or object to the electrons or ions. A "circuit" or "electronics package" is a combination of a number of electrical devices and conductors that when connected together, form a conducting path to fulfill a desired function, such as amplification, filtering, or oscillation. Any constituent part of the circuit other than the interconnections is referred to as a "circuit element." A circuit may be comprised of discrete components, or it may be an "integrated circuit." A circuit is said to be "closed" when it forms a continuous path for current. It is contemplated that any number of devices be included within an electronics package. It is further intended that various components be included in multiple electronics packages that work cooperatively to amplify sound.

The term "piezoelectric effect" refers to the property of certain crystalline or ceramic materials to emit electricity when deformed and to deform when an electric current is passed across them, a mechanism of interconverting electrical and acoustic energy; an ultrasound transducer sends and receives acoustic energy using this effect.

The present invention relates to partially implantable medical devices for improving sound perception by subjects with conductive or mixed hearing loss. In particular, the present invention provides improved methods and devices for driving a large inertial or torquing mass to vibrate the skull of a hearing impaired subject, resulting in fluidic motion of the inner ear and perception of sound.

I. Prior Devices

Two early attempts utilizing bone conductive and surgical components to better treat conductive hearing loss include the BAHA (bone anchored hearing aid marketed by Entific Medical Systems AB of Sweden), and the XOMED AUDIANT (surgically implanted hearing aid marketed by Xomed Inc., of North Jacksonville, Fla.).

A. Bone Anchored Hearing Aid (BAHA)

This system operates in a relatively simple fashion as described in U.S. Pat. No. 4,498,461 to Hakansson, and more recently in WO 2005/037153 of Pitulia (both herein incorporated by reference in their entirety). Briefly, a surgeon uses a supplied kit to surgically attach a "plug" (bone screw) through a patient's skin to the mastoid region of the skull. An external "vibrator" is then placed onto its distal (extruding) end. The vibrator contains a microphone, battery, amplifier and sound processing electronics for production of vibrations in response to sound. In this way, the BAHA system permits patients to hear bone conductive sound via the percutaneous plug.

Principal Advantages:

The BAHA device can be installed on an outpatient basis in about a half an hour. The implant is passive (only a titanium screw), while the active component resides outside the body. Thus, if a vibrator should wear out or fail it can be easily replaced by a physician or audiologist.

Principal Disadvantages:

There are three significant drawbacks to the BAHA approach. First, the site of the percutaneous plug is highly susceptible to infection and adverse tissue reactions. Secondly, the single contact point of the percutaneous plug, where it screws to or is osteointegrated into the skull, is a critical point that can easily become disarticulated. This issue is potentially compounded by the vibrational forces transmitted to the plug, which could facilitate device translocation. Lastly, for many individuals having a metal plug protruding through the skin of their or a loved one's head is cosmetically repellant. Often this rejection manifests to such a degree that it can be described as "exuberant rejection."

B. XOMED AUDIANT

The XOMED AUDIANT device was designed to overcome the limitations and "exuberant rejection" issues associated with the percutaneous plug of the BAHA. This device was implanted in over 2,000 patients within the first 24 months of introduction, pointing to a real need for such a device experienced by many conductive hearing loss patients. Briefly, the XOMED AUDIANT includes a subcutaneous plug in the form of a titanium encapsulated rare earth magnet that is screwed into the skull and an external vibrator that is held in position over the implant via a magnet. The external vibrator includes a magnet, sound amplification electronics, a battery and a broadband (audio-band) induction coil contained within a housing. U.S. Pat. No. 4,352,960 to Dormer et al. and U.S. Pat. No. 4,612,915 to Hough et al. describe the XOMED AUDIANT, and are both herein incorporated by reference in their entirety.

Principal Advantages:

The main advantages of the XOMED AUDIANT include the ease of installation of the internal unit, and the lack of a percutaneous component. Additionally, the Xomed device was a significant cosmetic improvement over the BAHA.

Principal Disadvantages:

Although the XOMED AUDIANT system worked well in some patients, the design of the device was poor in that the vibrator frequently fell off during use. This problem was compounded in that the more amplification that was delivered, the more likely the vibrator was to become dislodged. Moreover, the use of a broadband induction coil and a non-shielded magnet made the device susceptible to electromagnetic interference.

II. Bone Bridge Device

The Bone Bridge device of the present invention is a superior bone conduction hearing aid. Briefly, the Bone Bridge system employs a transducer configured to conduct sound in the form of vibrations through a subject's skull. In some preferred embodiments, the transducer is a floating mass transducer (FMT) similar to that of Vibrant Med-El Hearing Technology GmbH of Austria (described in U.S. Pat. No. 5,913,815 to Ball et al., herein incorporated by reference in its entirety) adapted to vibrate the temporal bone of a subject in response to an electrical signal representing sound waves.

A. Floating Mass Transducer (FMT)

The present invention relates to the field of devices and methods for improving hearing in hearing impaired persons. The present invention provides an improved implantable transducer for transmitting vibrations to a subject's skull. A "transducer" as used herein is a device that converts energy or information of one physical quantity into another physical quantity. For example, a microphone is a transducer that converts sound waves into electrical impulses.

In preferred embodiments, the transducer is a floating mass transducer having a "floating mass" that vibrates in direct response to an external signal corresponding to sound waves. The mass is mechanically coupled to a housing that is mounted to the temporal bone of a subject. Thus, the mechanical vibration of the floating mass is transformed into a vibration of the skull allowing the subject to hear (or enhancing residual sound perception). A floating mass transducer can also be utilized as a transducer to transform mechanical vibrations into electrical signals.

In order to understand the present invention, it is necessary to understand the theory upon which the floating mass transducer is based—the conservation of energy principle. The conservation of energy principle states that energy cannot be created or destroyed, but only changed from one form to another. More specifically, the mechanical energy of any system of bodies connected together is conserved (excluding friction). In such a system, if one body loses energy, a connected body gains energy.

In general, a floating mass transducer includes a floating mass connected to a counter mass by a flexible connection. The flexible connection is an example of a mechanical coupling that allows vibrations of the floating mass to be transmitted to the counter mass. In operation, a signal corresponding to sound waves causes the floating mass to vibrate. As the floating mass vibrates, the vibrations are carried through the flexible connection to the counter mass. The resulting inertial vibration of the counter mass is generally "counter" to the vibration of the floating mass. The relative vibration of each mass is generally inversely proportional to the inertia of the masses. Thus, the relative vibration of the masses is affected by the relative inertia of each mass. The inertia of the mass can be affected by the quantity of matter (obtained by dividing the weight of the body by the acceleration due to gravity) or other factors (e.g., whether the mass is attached to another structure). In this simple example, the inertia of a mass is presumed to be equal to its quantity of matter.

In instances when the floating mass is larger than the counter mass, the relative vibration of the floating mass is less than the relative vibration of the counter mass. In one embodiment of the present invention, a magnet comprises the floating mass. The magnet is disposed within a housing such that it is free to vibrate relative to the housing. A coil is secured to the housing to produce vibration of the magnet when an alternating current flows through the coil. Together the housing and coil comprise the counter mass and transmit a vibration to a subject's skull in response to sound waves.

In contrast, when the floating mass is smaller than the counter mass, the relative vibration of the floating mass is more than the relative vibration of the counter mass. In one embodiment of the present invention, a coil and diaphragm together comprise the floating mass. The diaphragm is a part of a housing and the coil is secured to the diaphragm within the housing. The coil is disposed within a housing such that it is free to vibrate relative to the housing. A magnet is secured within the housing such that the coil vibrates relative to the magnet when an alternating current flows through the coil. Together the housing and magnet comprise the counter mass. In this embodiment, the coil and diaphragm (floating mass) transmits a vibration to a subject's skull.

The above discussion is intended to present the basic theory of operation of the floating mass transducer of the present invention. The fully implantable floating mass transducer is vibrationally couplable to a subject's skull, meaning that the transducer is able to transmit vibration to a subject's skull. As an example, the floating mass transducer (vibratory unit) is mounted to a subject's skull with a mounting mechanism such as glue, adhesive, velcro, sutures, suction, screws, springs, and the like.

In an exemplary embodiment, the floating mass transducer comprises a magnet assembly and a coil secured inside a housing, which is typically sealed for implantable devices where openings might increase the risk of infection. For implantable configurations, the housing is proportioned to be affixed to a subject's temporal bone.

While the present invention is not limited by the shape of the housing, it is preferred that the housing is of a cylindrical capsule shape. Similarly, it is not intended that the invention be limited by the composition of the housing, although it is preferred that the housing be composed of, and/or coated with, a biocompatible material.

The housing contains both the coil and the magnet assembly. Typically, the magnet assembly is positioned in such a manner that it can oscillate freely without colliding with either the coil or the interior of the housing itself. When properly positioned, a permanent magnet within the assembly produces a predominantly uniform flux field. Although this embodiment of the invention involves use of permanent magnets, electromagnets may also be used.

Various components are involved in delivering the signal derived from externally generated sound to the coil affixed within the housing of the vibratory unit. First, an external sound transducer similar to a conventional hearing aid transducer is positioned on the skin of a subject. This external transducer (audio processor unit) processes the sound and transmits a signal, by means of magnetic induction, to a subcutaneous coil transducer (receiver unit). From a coil located within the implantable receiver unit, alternating current is conducted by a pair of leads to the coil of the transducer of the implantable vibratory unit. In preferred embodiments, the coil of the transducer of the vibratory unit is more rigidly affixed to the wall of the housing than is the magnet located therein. The external audio processor unit is held in position by juxtaposition to the implantable receiver unit, by virtue of magnetic attraction.

When the alternating current is delivered to the vibratory unit housing, attractive and repulsive forces are generated by the interaction between the magnet and the coil. Because the coil is more rigidly attached to the housing than the magnet assembly, the coil and housing move together as a unit as a result of the forces produced. The vibrating transducer triggers sound perception of the highest quality when the relationship between the housing's displacement and the coil's current is substantially linear. Such linearity is best achieved by positioning and maintaining the coil within the substantially uniform flux field produced by the magnet assembly.

For the transducer to operate effectively, it should vibrate the skull with enough force to transfer the vibrations to the cochlear fluid within the inner ear. The force of the vibrations created by the transducer of the vibratory unit can be optimized by maximizing both the mass of the magnet assembly relative to the combined mass of the coil and the housing, and the energy product (EP) of the permanent magnet.

In some preferred embodiments, the floating mass transducer is an electromagnetic floating mass transducer. It is commonly known that a magnet generates a magnetic field. A coil that has a current flowing through it also generates a magnetic field. When the magnet is placed in close proximity to the coil and an alternating current flows through the coil, the interaction of the respective magnetic fields cause the magnet and coil to vibrate relative to each other. This property of the magnetic fields of magnets and coils provides the basis for floating mass transducers as follows.

1. Floating Mass Magnet

In an exemplary embodiment, the floating mass is a magnet. The transducer is generally comprised of a sealed housing having a magnet assembly and a coil disposed inside it. The magnet assembly is loosely suspended within the housing, and the coil is rigidly secured to the housing. Preferably, the magnet assembly includes a permanent magnet and pole pieces. When alternating current is conducted to the coil, the coil and magnet assembly oscillate relative to each other and cause the housing to vibrate. The housing is proportioned for attachment to a subject's temporal bone. The exemplary housing is preferably a cylindrical capsule having a diameter of 1 mm and a thickness of 1 mm, and is made from a biocompatible material such as titanium. The housing has first and second faces that are substantially parallel to one another and an outer wall that is substantially perpendicular to the faces. Affixed to the interior of the housing is an interior wall, which defines a circular region and which runs substantially parallel to the outer wall.

The magnet assembly and coil are sealed inside the housing. Air spaces surround the magnet assembly so as to separate it from the interior of the housing and to allow it to oscillate freely without colliding with the coil or housing. The magnet assembly is connected to the interior of the housing by flexible membranes such as silicone buttons.

The magnet assembly may alternatively be floated on a gelatinous medium such as silicon gel, which fills the air spaces in the housing. A substantially uniform flux field is produced by this configuration. The assembly includes a permanent magnet positioned with ends containing the south and north poles substantially parallel to the circular faces of the housing. A first cylindrical pole piece is connected to the end containing the south pole of the magnet and a second pole piece is connected to the end containing the north pole. The first pole piece is oriented with its circular faces substantially parallel to the circular faces of the housing. The second pole piece has a circular face having a rectangular cross-section and which is substantially parallel to the circular faces of the housing. The second pole piece additionally has a pair of walls that are parallel to the wall of the housing and which surrounds the first pole piece and the permanent magnet.

The pole pieces should be manufactured out of a magnetic material such as ferrite or SmCo. They provide a path for the magnetic flux of the permanent magnet, which is less resistive than the air surrounding the permanent magnet. The pole pieces conduct much of the magnetic flux and thus cause it to pass from the second pole piece to the first pole piece at the gap in which the coil is positioned.

For the device to operate properly, it should vibrate a subject's temporal bone with sufficient force such that the vibrations are perceived as sound waves. The force of vibrations is best maximized by optimizing two parameters: the mass of the magnet assembly relative to the combined mass of the coil and housing, and the energy product (EP) of the permanent magnet. The ratio of the mass of the magnet assembly to the combined mass of the magnet assembly, coil and housing is most easily optimized by constructing the housing of a thinly machined, lightweight material such as titanium, and by configuring the magnet assembly to fill a large portion of the space inside the housing. However, there should be adequate spacing between the magnet assembly and the housing and coil for the magnet assembly to vibrate freely within the housing.

The magnet should preferably have a high-energy product. NdFeB magnets having energy products of forty-five and SmCo magnets having energy products of thirty-two are presently available. A high-energy product maximizes the attraction and repulsion between the magnetic fields of the coil and magnet assembly and thereby maximizes the force of the oscillations of the transducer. Although it is preferable to use permanent magnets, electromagnets may also be used in carrying out the present invention.

The coil partially encircles the magnet assembly and is fixed to the wall of the housing such that the coil is more rigidly fixed to the housing than the magnet assembly. Air spaces separate the coil from the magnet assembly. In one implementation where the transducer is implanted, a pair of leads is connected to the coil and passes through an opening in the housing to the exterior of the transducer, and attach to a coil of an implantable (subcutaneous) receiver unit. The receiver unit is implanted beneath the skin behind the ear, delivers alternating current to the coil of the vibratory unit via the lead. The opening is closed around the leads to form a seal preventing contaminants from entering the transducer.

The perception of sound triggered by the implantable vibratory unit is of the highest quality when the relationship between the displacement of the housing and the current in the coil is substantially linear. For the relationship to be linear, there should be a corresponding displacement of the housing for each current value reached by the alternating current in the coil. Linearity is most closely approached by positioning and maintaining the coil within the substantially uniform flux field produced by the magnet assembly.

When the magnet assembly, coil, and housing are configured as described, alternating current in the coil causes the housing to oscillate side-to-side. The transducer is most efficient when positioned such that the side-to-side movement of the housing produces side-to-side movement, which is imparted to a temporal bone of a subject and ultimately to the cochlear fluid of the inner ear.

In some preferred embodiments, an external sound transducer (audio processor unit), is substantially identical in design to a conventional hearing aid transducer and is comprised of a microphone, sound processing unit, amplifier, battery, and external coil. The external audio processor unit is positioned on the exterior of the skull. A subcutaneous coil transducer (implantable receiver unit) is coupled to the transducer of the implantable vibratory unit, and is typically positioned under the skin behind the ear such that the external coil is positioned directly over the location of the subcutaneous coil.

Sound waves are converted to an electrical signal by the microphone and sound processor of the external audio processor unit (sound transducer). The amplifier boosts the signal and delivers it to the external coil, which subsequently delivers the signal to the subcutaneous coil by magnetic induction. A coupling such as leads conduct the signal to transducer of the implantable vibratory unit attached to a subject's temporal bone. When the alternating current signal representing the sound wave is delivered to the coil of the implantable vibratory unit, the magnetic field produced by the coil interacts with the magnetic field of the magnet assembly.

As the current alternates, the magnet assembly and the coil both attract and repel one another. The alternating attractive and repulsive forces cause the magnet assembly and the coil to alternatingly move towards and away from each other. Because the coil is more rigidly attached to the housing than is the magnet assembly, the coil and housing move together as a single unit. The directions of the alternating movement of the housing are ultimately conducted as vibrations to the cochlear fluid.

2. Floating Mass Coil

In another embodiment, the floating mass is the coil. The transducer is generally comprised of a housing having a magnet assembly and a coil disposed inside it. The housing is generally a cylindrical capsule with one end open, which is sealed by a flexible diaphragm. The magnet assembly may include a permanent magnet and pole pieces, to produce a substantially uniform flux field. The magnet assembly is secured to the housing, and the coil is secured to flexible diaphragm. The diaphragm may comprise an attachment means for affixing it to a subject's temporal bone.

The coil is electrically connected to an external power source, which provides alternating current to the coil through leads. When alternating current is conducted to the coil, the coil and magnet assembly oscillate relative to each other causing the diaphragm to vibrate. Preferably, the relative vibration of the coil and diaphragm is substantially greater than the vibration of the magnet assembly and housing.

For the device to operate properly, it should vibrate a subject's skull with sufficient force such that the vibrations are perceived as sound waves. The force of vibrations is best maximized by optimizing two parameters: the combined mass of the magnet assembly and housing relative to the combined mass of the coil and diaphragm, and the energy product (EP) of the magnet. The ratio of the combined mass of the magnet assembly and housing to the combined mass of the coil and diaphragm is most easily optimized by constructing the diaphragm of a lightweight flexible material like Mylar. The housing should be a biocompatible material like titanium. The magnet should preferably have a high-energy product. A high-energy product maximizes the attraction and repulsion between the magnetic fields of the coil and magnet assembly and thereby maximizes the force of the oscillations produced by the transducer. Although it is preferable to use permanent magnets, electromagnets may also be used in carrying out the present invention.

3. FMT Modifications

The following modifications to the original FMT design have been made for their use in treating patients with conductive or mixed hearing loss. The size of the FMT has been increased to approximately 20 millimeters in diameter (15 to 30 mm) by approximately 6.5 millimeters thick (5-7 mm) Additionally, the coil of the FMT is now made of MRI-compatible material. A simplified surgical approach is employed to attach the FMT to the skull of a patient via bone screws, bone cement or osteointegation in a short outpatient procedure (e.g., ~30 minute office visit). Furthermore, the technology can be tested on a patient before implantation, by affixing a demonstration unit to the outside of the skin and driving the unit approximately 20 dB louder to achieve similar sensation levels to that afforded by an implanted patient unit.

B. Exemplary Embodiments

FIGS. 1A and 1B depict one embodiment of the present invention termed the Bone Bridge Flex unit. In this embodiment, a dual opposing magnet type floating mass transducer (FMT) is employed having a single MRI-compatible coil. In this type of FMT, a separation material is sandwiched between two opposing magnets (north to north). The FMT comprises multiple ear style bone attachment means to facilitate surgical mounting to the skull with bone screws. A demodulator is located between the FMT and the receiving coil. Materials in contact with a patient's body are biocompatible materials such as silicone elastomer and titanium. Exemplary secondary materials for components not in contact with a patient's body are polyimid-coated gold and titanium.

Figure 2:
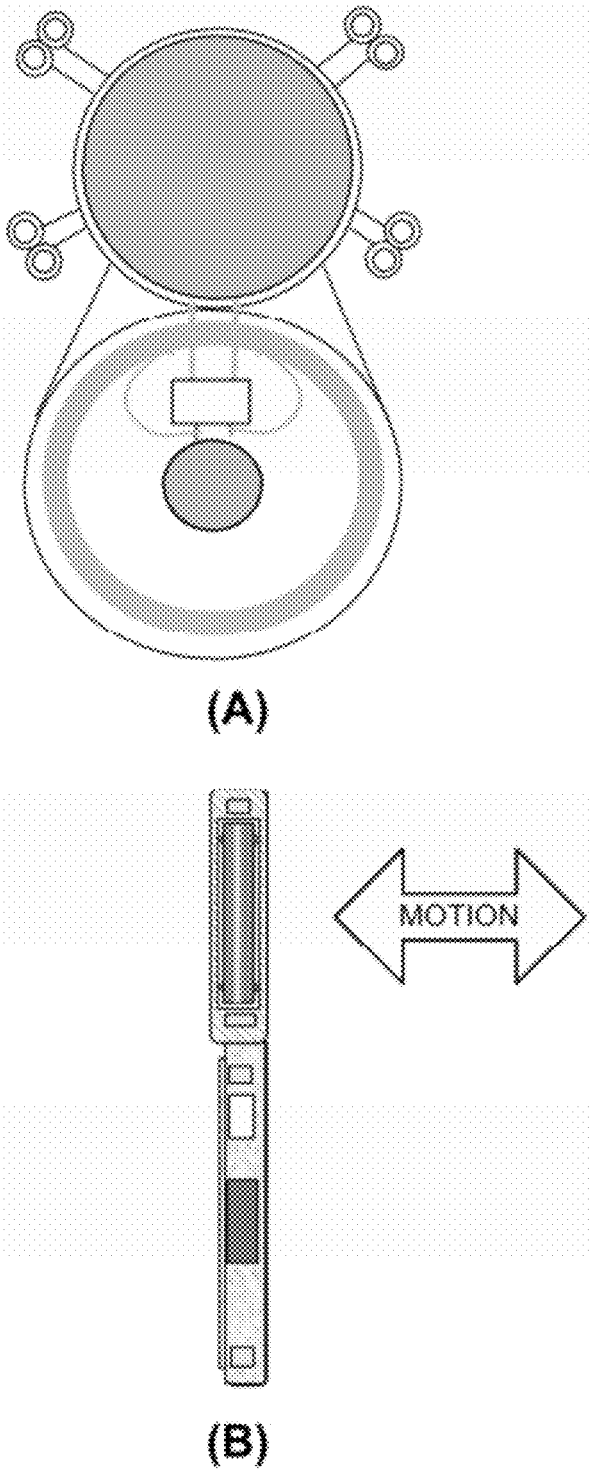
FIG. 2A-B shows a top plan view and side cross-sectional view respectively of an embodiment of the present invention (known as "BoneBridge Compact") having a demodulator positioned within the receiver coil of the receiver unit. This configuration provides additional strain relief and isolation of the demodulator from the FMT of the vibratory unit within a shorter device.

FIGS. 2A and 2B depict one embodiment of the present invention termed the Bone Bridge Flex Compact unit. In this embodiment, the demodulator resides within the receiver coil to afford additional strain relief and to further isolate it from the FMT. This configuration results in a slightly shorter device. However, in other embodiments the FMT unit is tethered to the receiver unit via electronic leads to provide even greater strain relief and isolation, albeit with a slightly longer device. In some instances, the lead wires are coiled to improve survivability and reduce wear.

Figure 3:
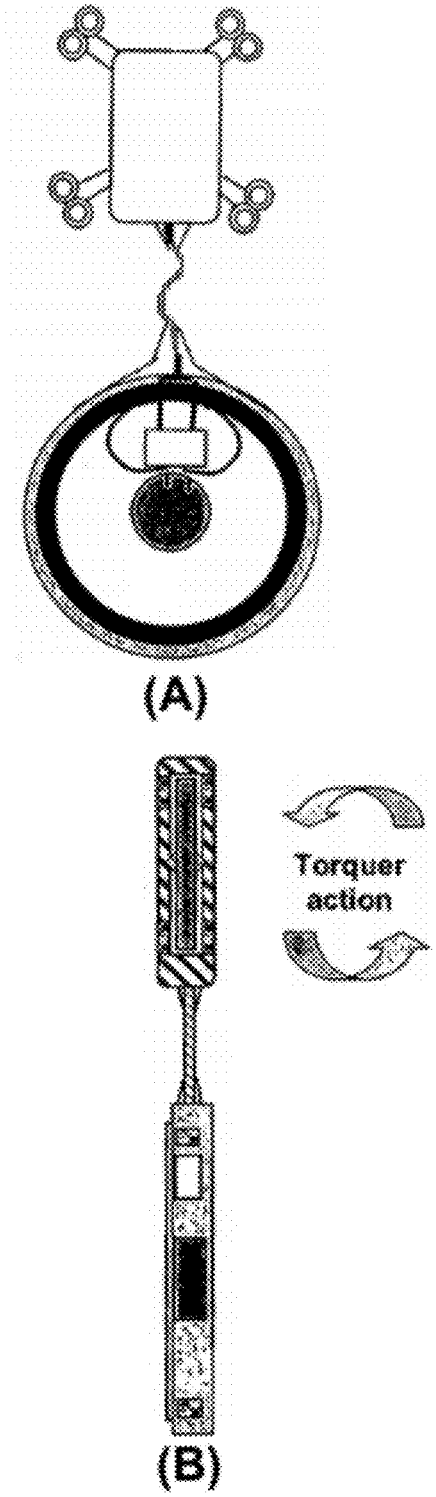
FIG. 3A-B shows a top plan view and side cross-sectional view respectively of an embodiment of the present invention (known as "BoneBridge Torque") having a demodulator positioned within the receiver coil of the receiver unit which is connected to a torquing FMT of the vibratory unit through flexible leads.

FIGS. 3A and 3B depict one embodiment of the present invention termed the Bone Bridge Torquer unit. In this embodiment, the FMT has a torqueing inertial mass comprising dual MIZI-compatible coils, and a single magnet suspended between central springs, for contacting the skull with rotational force.

Figure 4:
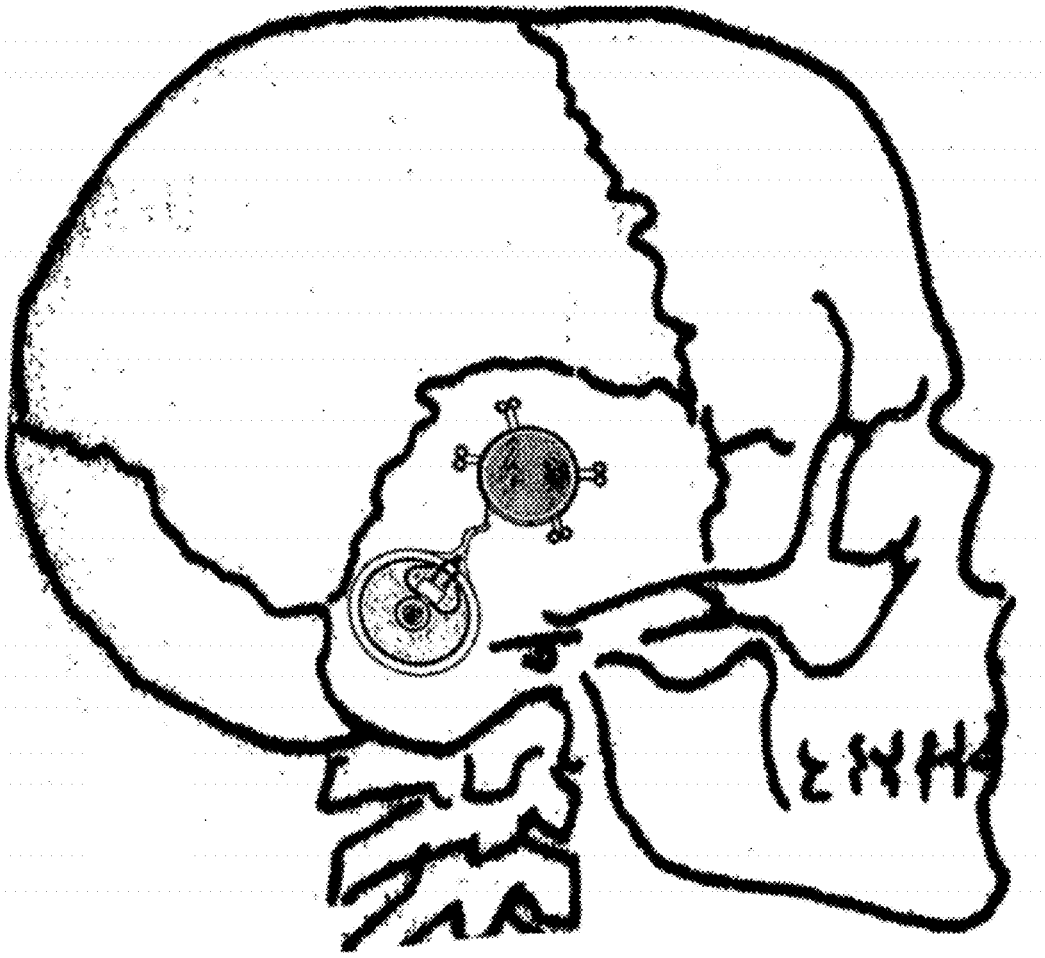
FIG. 4 depicts an embodiment of the present invention positioned to vibrate a subject's skull in response to sound. In this embodiment, titanium ears are provided to attach the vibratory unit containing the FMT to the skull via bone screws.

FIG. 4 illustrates positioning of a Bone Bridge device on a patient's skull. Many patients have a vibrational "sweet spot" behind the Pinna of the ear that conducts vibrations to the inner ear. In some methods of the present invention, a patient's vibrational sweet spot is identified prior to surgery by using a Bone Bridge demonstration unit. This permits optimal anatomical placement of the FMT during implantation. The external audio processor unit, which is held in position over the receiver portion by magnetic attraction, supplies an amplified electronic signal for driving the FMT and resultant skull vibrations. Importantly, the implant does not comprise a percutaneous plug, and the skull vibration means and the audio processor attachment means comprise distinct components.

Figure 5:
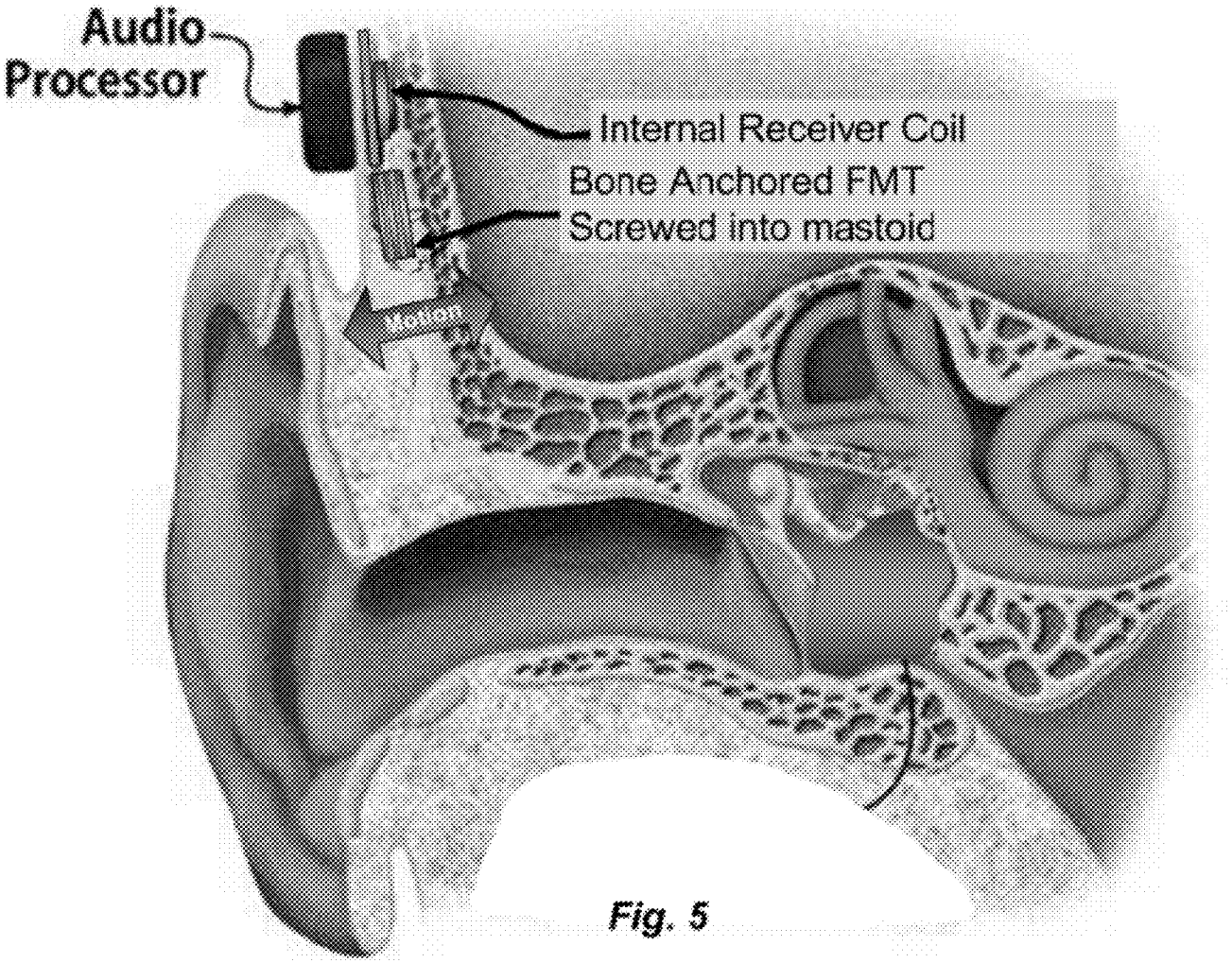
FIG. 5 depicts an embodiment of the present invention having separate and distinct vibratory or drive (bone anchored FMT), receiver and audio processor units. The transducer of the vibratory unit is a "donut" type transducer that is attached to the mastoid bone via a single titanium bone screw driven through the center of the FMT unit. While having greater surgical ease, the single point attachment unit is contemplated to have a higher propensity to become loose thereby introducing distortion and lower vibrational signals.

In further embodiments, the Bone Bridge device comprises separate implantable attachment and vibratory units as shown in FIG. 5. The attachment unit comprises a magnet for holding the external audio processor unit in place. An audio band conduction coil within the audio processor housing drives the magnetic vibratory unit. The attachment and vibratory magnets are rare earth magnets (e.g., titanium) that are surgically mounted to the skull with one or more bone screws. In a further embodiment, the audio processor and conduction or drive coil are contained in separate housings that are connected via a tether. This configuration serves to reduce vibration of the audio processor caused by the implanted vibratory unit. In this instance, a small ferrous component or magnet is used inside the receiver coil to facilitate positioning of the coil relative to the implanted vibratory unit. Thus, the detachment problem of the audio processor unit of the prior art devices (propensity to fall off a patient's head) is remedied in large part by not using the implanted vibratory magnet as both the drive magnet and attachment magnet.

Figure 6:
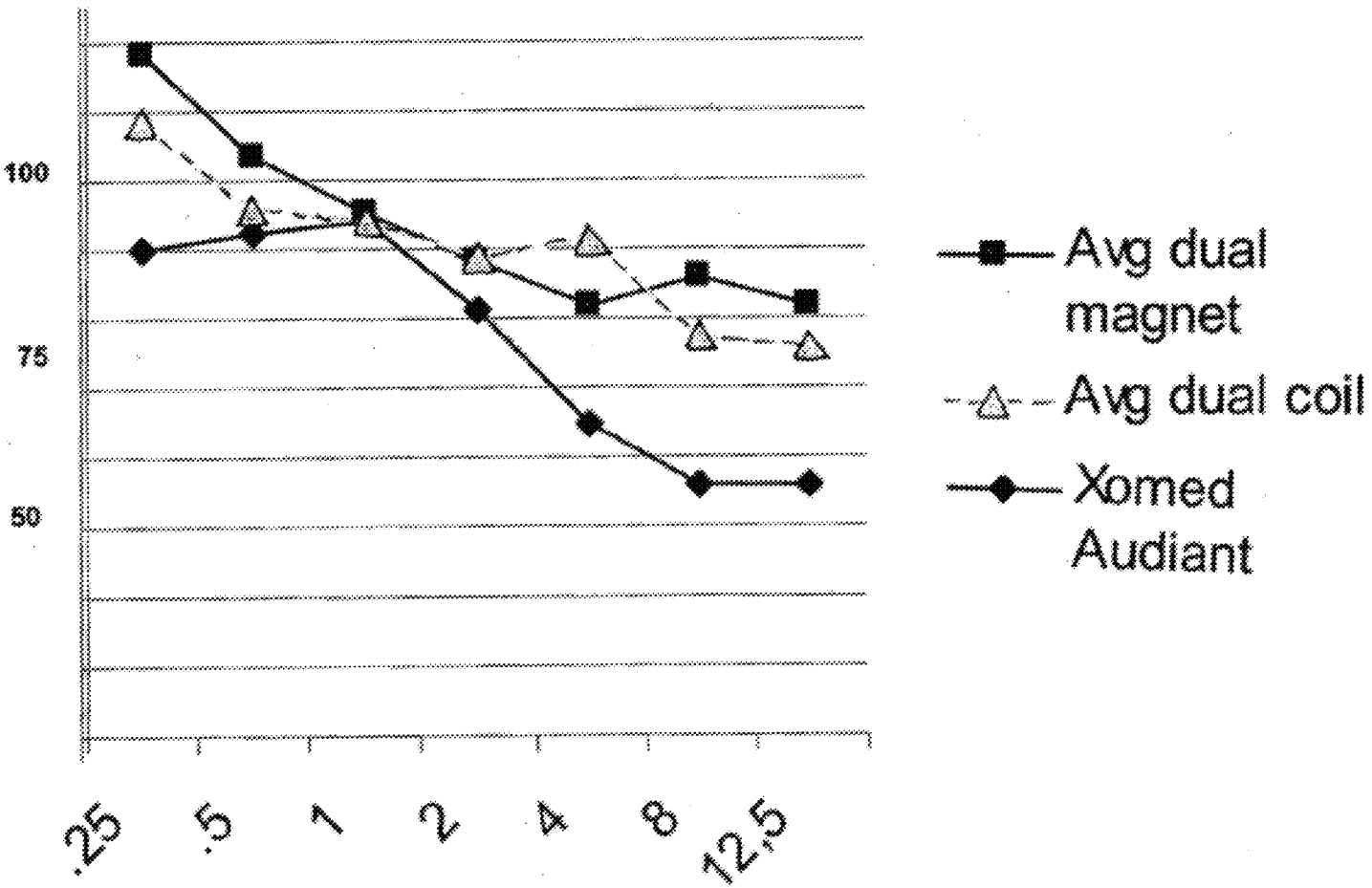
FIG. 6 shows the result of a comparison of dual coil units, dual magnet units and a XOMED AUDIANT device as measured on a B & K artificial mastoid. The results indicate that the devices of the present invention produce more vibration in response to the same input signal, with the exception of the resonant point of the XOMED AUDIANT device (1500 Hz). Output in relative decibels on the y-axis is shown versus input frequency in megahertz on the x-axis.

Multiple Bone Bridge transducer prototypes have been built and tested. In the first test, patient data is indicative of a device that produces thresholds at 100 mV inputs of 80 dB (across the skin of the mastoid). When the device is surgically mounted on the bone, this level is contemplated to be 95 dB or more. Secondly, RTF measurements of a transducer with a complete cadaver head and a complete implant prototype driven with by an exemplary audio processor that showed the output for a bone anchored mono coil dual magnet device to be in the 100-110 dB range for a 100 mV input signal (frequencies from 1-8 kHz). Thirdly, mounting a Bone Bridge transducer on a temporal bone and measuring the displacement of the stapes and the ossicular chain, indicated that the exemplary device drove the ear at 95 dB for a 100 mV input signal to the transducer. Lastly, as shown in FIG. 6, both dual coil and dual magnet prototypes were shown to be superior (greater output to input ratio) to the XOMED AUDIANT device at both higher and lower frequencies.

Principal Advantages:

The main advantages of the Bone Bridge hearing device include the ease of installation of the internal unit(s), and the lack of a percutaneous component. Additionally, by utilizing distinct implantable drive and attachment units (unlike the BAHA and XOMED AUDITANT devices of the prior art) the present invention has multiple beneficial properties. In the first place there is a reduction in feedback potential between the implanted drive unit and the external audio processor housing, resulting in an improvement in electronic programming headroom thereby allowing the system to deliver more gain and/or output. Secondly, there is a significant reduction in propensity to vibrate the external electronics package or audio processor off of the patient's skull. Thirdly, the use of a vibrating stage and an attachment/receiving stage although physically larger provides a superior cosmetic solution in that the external processing unit could then be located under the hair.

C. Treatment Population

The present invention provides partially implantable hearing devices comprising a subcutaneous floating mass transducer (FMT) and an external audio processor unit for improving hearing in select patients. General audiometric criteria for patients in some embodiments of the present invention include: diagnosis of conductive or mixed conductive/sensorineural hearing loss by physician and audiologist, non-perforated tympanic membrane, no retro-cochlear involvement, speech discrimination of at least 70%, no middle ear surgical prosthesis, inadequate benefit from conventional hearing aids, and other therapies rejected. Additional specific audiometric criteria include: maximum measurable bone conduction levels of 50 dB at 0.5, 1, 2, 3, 4 kHz, and successful function demonstrated with a Bone Bridge demonstration device.

All publications and patents mentioned in the above specification are herein incorporated by reference. Various modifications and variations of the described method and system of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention, which are obvious to those skilled in the relevant fields are intended to be within the scope of the following claims.

Embodiments of the invention may be implemented in part in any conventional computer programming language such as VHDL, SystemC, Verilog, ASM, etc. Alternative embodiments of the invention may be implemented as pre-programmed hardware elements, other related components, or as a combination of hardware and software components.

Embodiments can be implemented in part as a computer program product for use with a computer system. Such implementation may include a series of computer instructions fixed either on a tangible medium, such as a computer readable medium (e.g., a diskette, CD-ROM, ROM, or fixed disk) or transmittable to a computer system, via a modem or other interface device, such as a communications adapter connected to a network over a medium. The medium may be either a tangible medium (e.g., optical or analog communications lines) or a medium implemented with wireless techniques (e.g., microwave, infrared or other transmission techniques). The series of computer instructions embodies all or part of the functionality previously described herein with respect to the system. Those skilled in the art should appreciate that such computer instructions can be written in a number of programming languages for use with many computer architectures or operating systems. Furthermore, such instructions may be stored in any memory device, such as semiconductor, magnetic, optical or other memory devices, and may be transmitted using any communications technology, such as optical, infrared, microwave, or other transmission technologies. It is expected that such a computer program product may be distributed as a removable medium with accompanying printed or electronic documentation (e.g., shrink wrapped software), preloaded with a computer system (e.g., on system ROM or fixed disk), or distributed from a server or electronic bulletin board over the network (e.g., the Internet or World Wide Web). Of course, some embodiments of the invention may be implemented as a combination of both software (e.g., a computer program product) and hardware. Still other embodiments of the invention are implemented as entirely hardware, or entirely software (e.g., a computer program product).

Although various exemplary embodiments of the invention have been disclosed, it should be apparent to those skilled in the art that various changes and modifications can be made which will achieve some of the advantages of the invention without departing from the true scope of the invention.

What is claimed is:

1. A method of providing sound perception in a hearing impaired patient, the method comprising:

receiving an externally generated electrical audio stimulation signal in a receiver unit located under the skin of an implanted patient, the receiver unit including an attachment magnet for holding a corresponding external transmitter unit in place on the skin over the receiver unit;

delivering the electrical audio stimulation signal from the receiver unit to an implanted bone conduction transducer having a planar bone engagement surface mounted to a temporal bone surface of the patient, wherein the bone conduction transducer is separate from and adjacent to the receiver unit so that the external transmitter unit is not directly over the bone conduction transducer;

transforming the electrical audio stimulation signal into a corresponding mechanical stimulation signal without directly vibrating the external transmitter device and coupled to the temporal bone by the bone engagement surface for delivery by bone conduction through the temporal bone to the cochlear fluid of the patient for perception as sound.

2. The method of claim 1, wherein the transducer includes a transducer housing containing a first mass that vibrates relative to a second mass when developing the mechanical stimulation signal.

3. The method of claim 2, wherein the first mass includes a permanent magnet, and the second mass includes an electromagnetic coil coupled to the transducer housing, and wherein the electrical audio stimulation signal is applied to the coil and causes the magnet to vibrate relative to the transducer housing.

4. The method of claim 1, wherein the electrical audio stimulation signal is delivered to the transducer by one or more leads of less than 15 mm in length.

5. The method of claim 1, wherein the transducer has a diameter of less than 30 mm and a width of less than 7 mm.

6. The method of claim 1, wherein the hearing impaired patient has one or more of the following conditions, malformation of the external ear canal or middle ear, chronic otitis media, tumor of the external ear canal or tympanic cavity.

7. The method of claim 1, wherein the hearing impaired patient has a maximum measurable bone conduction level of less than 50 dB at 50, 1000, 2000 and 3000 Hertz.

* * * * *